343-755 SR
5/13/81 XR 4,234,991

United States Patent [19]
Dupressoir

[11] 4,284,991
[45] Aug. 18, 1981

[54] COMMON ANTENNA FOR PRIMARY AND SECONDARY RADAR SYSTEM

[75] Inventor: Albert Dupressoir, Paris, France

[73] Assignee: Thomson-CSF, Paris, France

[21] Appl. No.: 105,733

[22] Filed: Dec. 20, 1979

[30] Foreign Application Priority Data

Dec. 27, 1978 [FR] France ..... 78 36484

[51] Int. Cl.[3] ..... H01Q 13/18; H01Q 19/195; H01Q 21/28

[52] U.S. Cl. ..... 343/725; 343/756; 343/771; 343/840

[58] Field of Search ..... 343/725, 729, 756, 767, 343/771, 840, 854

[56] References Cited

U.S. PATENT DOCUMENTS

| | | | |
|---|---|---|---|
| 3,039,098 | 6/1962 | Bickmore | 343/771 |
| 3,550,135 | 12/1970 | Bodmer | 343/725 |
| 3,701,158 | 10/1972 | Johnson | 343/725 |

*Primary Examiner*—Eli Lieberman
*Attorney, Agent, or Firm*—Karl F. Ross

[57] ABSTRACT

A bifunctional antenna of a primary/secondary radar system comprises a reflector having a concave front surface formed with a row of slots along a horizontal generatrix, the slots lying in front of respective cavities excitable to radiate interrogation signals in a directive sum pattern and supplemental radiation in a differential control pattern designed to blank minor lobes of the interrogation pattern. Some of the cavities and slots are symmetrically duplicated on a dielectric cap covering the convex rear surface of the reflector. The reflector and its cap form a closed shell of dielectric material, specifically a glass mat impregnated with epoxy resin, overlain at the front by a fiber-glass fabric incorporating orthogonally intersecting insulated copper wires. The fabric also lines the inner walls of each cavity which is filled with dielectric material; its radiating slot is spanned only by horizontal wires paralleling the plane of polarization of target-seeking radiation from a source illuminating the reflector.

16 Claims, 4 Drawing Figures

COMMON ANTENNA FOR PRIMARY AND SECONDARY RADAR SYSTEM

FIELD AND BACKGROUND OF THE INVENTION

My present invention relates to a common antenna for primary and secondary radar systems.

It is frequently necessary in a radar station to combine a number of antennas in the same operating location. However, this causes problems because the equipment in question has to be located in an area which is extremely restricted in the case of, for example, weapon systems. The combination of a primary radar antenna and a secondary radar antenna can be realized in two different ways. In one instance the antenna of the secondary radar is separate from that of the primary radar, the antennas installed in this way being essentially of the "beam" type. In the other instance the antenna of the secondary radar is integrated into the primary radar antenna, thus bringing about a true bifunctional antenna for the primary and secondary radars.

A bifunctional antenna for primary and secondary radars is generally constituted by a single reflector illuminated by a confronting source in such a way as to radiate energy into space for the purpose of detecting a target such as an aircraft, this being called the primary radar function, and also to transmit an interrogation signal to an aircraft equipped with a transporter which automatically transmits its answer, this being called the secondary radar function.

The radiated beam carrying the interrogation signal is effective in the direction where the aircraft has been detected. However, it has been found that the transponder of the interrogated aircraft or possibly that of a different aircraft could be triggered by secondary lobes of the interrogation diagram, whose level is liable to be relatively high compared with that of the major lobe. To obviate this disadvantage, the single antenna referred to can be provided with supplemental radiating elements affecting the reception of the interrogation signal by the remote transponder as well as the reception of the answer from the latter by the local receiver; these elements radiate in accordance with a quasi-omnidirectional control diagram whose level is such as to blank the secondary lobes of the interrogation diagram.

This arrangement makes it possible, by comparing the amplitude of the pulses received from the transponder and those received from the control system in the associated circuits, to determine the pulse received in reply to the interrogation by the major lobe.

The means for establishing the control diagram and affecting the transmission of an interrogation signal as well as the reception of a response signal from an interrogated target must be so designed that the gain of the associated control channel is greater than that of the interrogation and response channel in the angular zones containing the secondary lobes of the directional interrogation diagram, but much smaller in the direction of its major lobe.

In existing constructions the control means comprise radiating members, namely wave emitters, whose radiation pattern is of the omnidirectional type, positioned on the common reflector close to its boresight axis or on its upper part. They may also serve as the transmission source of the interrogation signal emitted for a limited time in a directive radiation pattern.

However, despite these precautions the radiation pattern of the control means does not completely fulfill its function, either because it is not totally omnidirectional or because certain high-level secondary lobes of the main directional pattern are not blanked and also because in some instances the major lobe may have such a low level as not to be absorbed by the omnidirectional diagram. Moreover, the control diagrams are disturbed by certain external structures, such as for example radomes under which the antennas are placed.

Finally, all these additional members, such as wave radiators, cause masking phenomena of the primary source due to the shadow created by these radiators on the surface of the reflector.

OBJECT OF THE INVENTION

The object of my present invention is to obviate these disadvantages and to provide means for optimizing the diagram of the control channel of the secondary radar without disturbing the operation of the primary radar.

SUMMARY OF THE INVENTION

A bifunctional antenna according to my present invention comprises an arcuate array of radiators integrated into a reflector serving for target detection, i.e. for the primary radar function, these radiators performing the interrogation function with a sum-type radiation pattern and being used at least in part as control means whose radiation pattern is of the differential type.

According to a more particular feature of my invention, the radiators serving as secondary radar transceivers are constituted by slots in a concave front surface of the reflector which are associated with radiating cavities distributed along a generatrix thereof preferably intersecting its boresight axis, the control channel being constituted by a certain number of slots in this array arranged symmetrically about that axis.

In order to have an optimum directional pattern in the horizontal or azimuthal plane, I prefer to dispose these slots on a horizontal generatrix. The cross-section of the reflector in a vertical plane can be circular, elliptical or rectilinear.

BRIEF DESCRIPTION OF THE DRAWINGS

The above and other features of my invention will now be described in greater detail with reference to the accompanying drawing in which.

DETAILED DESCRIPTION

Figure 1:
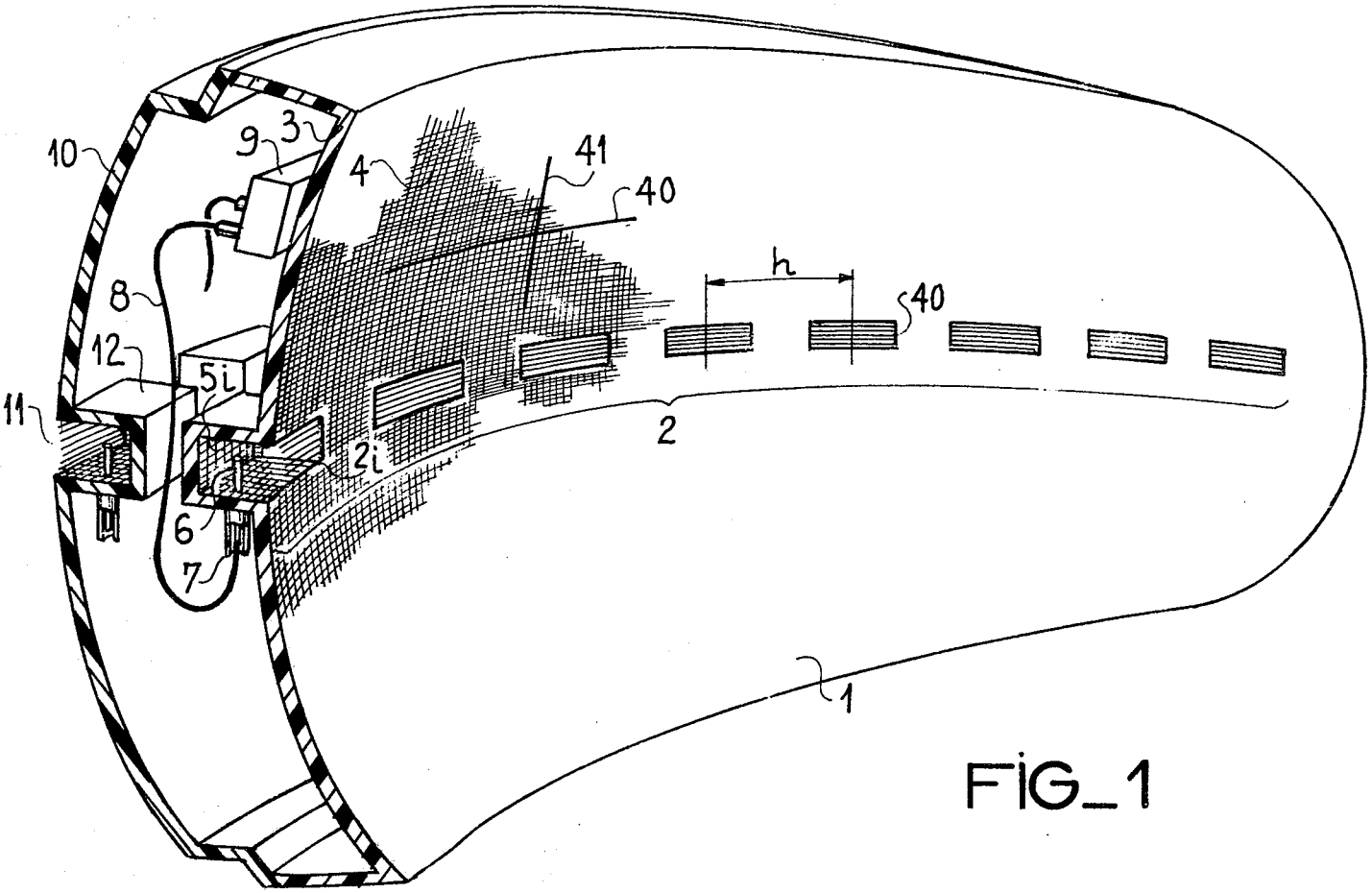
FIG. 1 is a section through a reflector of a bifunctional radar antenna according to the invention.

There is no longer any need to demonstrate the advantage of combining primary and secondary radar systems in the monitoring of space, particularly at approaches to airports or airfields. The primary radar detects the direction and distance of aircraft with respect to the antenna system and the secondary radar interrogates them; the transponders provided for this purpose on the aircraft transmit to the ground, i.e. to the interrogator, data relating to their altitude, identity, speed, etc. The interrogation of aircraft by the secondary radar takes place in the direction detected by the primary radar, so that it is of advantage either the couple the antennas of both radar systems or to use but a single antenna able to fulfill the two functions defined hereinbefore. However, as has been stated above, a conventional primary/secondary radar system has disadvantages which are prejudicial to its satisfactory operation and efficiency. Thus, as noted, the radiation pattern of the secondary radar has, in addition to a major lobe which transmits the interrogation and receives the response from the interrogated aircraft, secondary lobes whose level can be sufficient to trigger a transponder, the latter belonging either to the aircraft being interrogated or to another aircraft. In the latter case this can lead to errors which may have dangerous consequences.

I have found that the inadequacies of prior attempts to obviate these disadvantages by suppressing the secondary or lateral lobes of the interrogation diagram can be obviated by forming on the one hand an interrogation/response radiation pattern of the sum or additive type and on the other hand a control-channel radiation pattern of the differential or subtractive type. The main advantage of the subtractive type is the fact that the centerline of the gap in the differential pattern is constant throughout the elevational range, thus giving a better centering of the interrogation arc and, in principle, an increased stability of the latter along the elevation range. Beyond the central zone of the radiation pattern the problem of blanking the lateral lobes of the radiation pattern of the primary radar is solved by a suitable choice of the amplitude and phase distribution of the radiating elements. For the interrogation/response channel the radiators are to be excited with additive phasing but with staggered amplitudes, as with a Gaussian distribution, to obtain a sum-type radiation pattern; an excitation of a certain number of these radiators distributed symmetrically about the boresight axis, with subtractive phasing, makes it possible to obtain a radiation pattern of the differential type for the control channel.

The integration of the secondary radiators into the reflector of the primary antenna has the advantage of obviating any increase in the volume of the primary antenna, and consequently any increase in its weight and susceptibility to wind action. The driving mechanism for this device remains relatively simple and of small volume, which is particularly advantageous in weapon systems.

FIG. 1 diagrammatically shows a sectional view of a common antenna reflector 1 for a primary and a secondary radar system, the reflector being concave toward a nonillustrated primary source and having a linear row 2 of a multiplicity of slot radiators generally designated $2_i$. The slots are arranged along a generatrix lying in a horizontal midplane of the reflector and preferably extend over the entire aperture thereof. The slot spacing h is of the order of 0.6 to 0.8λ in a preferred embodiment. Reflector 1 has a body made from a dielectric material 3, namely an epoxy-resin-impregnated glass mat, covered by a fiberglass fabric 4 carrying two sets of orthogonally intersecting metal wires 40, 41. These wires are generally made from copper of limited thickness.

Behind each slot $2_i$ of the arcuate array 2 is a parallelepipedic radiating cavity $5_i$ whose walls are integral with and made of the same dielectric 3 as the body of reflector 1 and are covered by an extension of the fiberglass fabric 4 incorporating the wires 40, 41. The directions of polarization of the sources of the primary and secondary extensions are mutually perpendicular, specifically horizontal and vertical, respectively. In order to reflect both types of radiation, metal wires 40 and 41 cross one another over the entire surface of the reflector 1 and also within the cavities $5_i$, yet in front of the slots there are only wires 40 arranged parallel to the horizontal generatrix and thus to the plane of polarization of the target-seeking radiation emitted by the primary antenna source illuminating the reflector.

With a transmission frequency of $10^4$ MHz the diameter of metal wires 40 and 41 may be 0.12 mm and the distance between them may be of the order of 1.5 mm. The covering of the metal wires by glass fibers gives the fabric a homogeneous elasticity.

To reduce the volume of cavities $5_i$ and provide a simply constructed monolithic assembly, the cavities are filled with dielectric 3. The exciting elements 6 of cavities $5_i$, of the piston or crossbar type, are inserted in the dielectric 3 filling the cavities and have coaxial bases 7 coupling the cavities $5_i$ to coaxial lines 8 which connect them to a power divider 9 on the convex back surface of the reflector 1. This power divider 9, which can be constituted by distributors, is connected by an ultra-high-frequency feed line to a conventional system for generating outgoing interrogation signals and receiving incoming response signals. The back of the reflector is protected by a sealed cap 10 forming therewith a closed shell essentially made of the aforementioned dielectric material 3.

If it is found that the diagram of the control channel established by the forwardly radiating slots $2_i$ does not ensure proper blanking of the rear part of the directional diagram of the interrogation channel, that control channel is provided with one or more supplementary rearwardly radiating elements. These additional radiators may be one or more slots 11 formed in the dielectric material of cap 10 in line with cavities 12, conforming to the forwardly radiating cavities $5_i$ of reflector 1. There are only a limited number of slots 11 and they are placed in cap 10 in the plane of symmetry of reflector 1 containing the forwardly radiating slots.

As noted above, it is by means of the power divider 9 that the cavities $5_i$ and 12 associated with the slots $2_i$ and 11 are excited in order to generate a sum-type directional radiation pattern for the interrogation/response channel and a differential type pattern for the control channel. The slots of the control channel, no matter whether they radiate toward the front or the rear of the reflector 1, are subdivided into two equal groups which are excited in phase opposition by means of a $\pi$ phase shifter located in the power divider.

Figure 2:
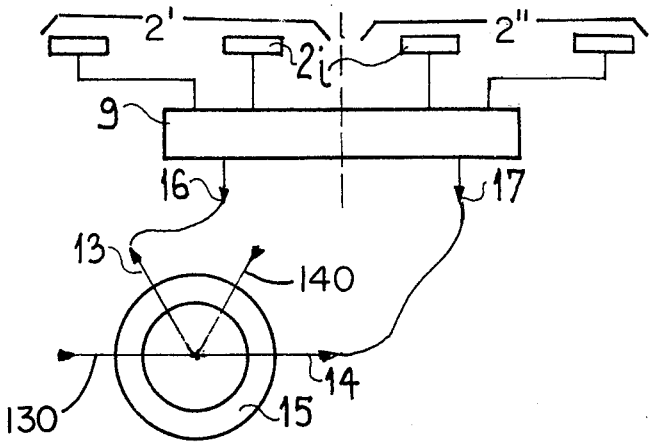
FIG. 2 is a diagram showing the connection between a 0–$\pi$ phase shifter and a power divider connected to the antenna structure of FIG. 1.

As can be gathered from FIG. 2, a $0-\pi$ hybrid phase shifter 15 has two output 13 and 14 which are in phase opposition and are respectively connected to terminals 16 and 17 of power distributor 9 for supplying the two groups 2', 2'' of slots $2_i$ forming part of the control channel. The phase shifter 15 has input terminals 130 and 140.

Figure 3:
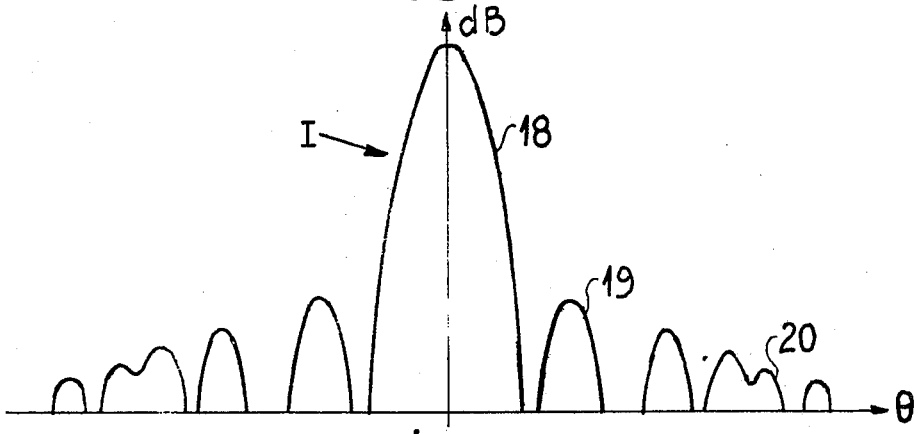
FIG. 3 shows the radiation pattern of an interrogation/response channel in the azimuthal plane of the bifunctional antenna according to the invention.

FIG. 3 shows the radiation pattern I of the sum or additive type generated by the interrogation channel, assigned to the secondary radar function, in the azimuthal plane indicated by the abscissa axis $\theta$ (azimuth angle); the ordinate axis represents gain in dB. The width 3 dB of its major lobe 18, associated with the desired gain along the maximum-radiation direction or boresight axis, is large compared with that of adjacent low-level lateral lobes 19 which are flanked by lobes 20 representing a still lower diffuse-radiation level.

These characteristics should exist not only in the plane containing the boresight axis but also over the entire elevational aperture of the operating field of radiation, in order to ensure the blanking of the interrogation diagram or pattern by that of the control channel.

Figure 4:
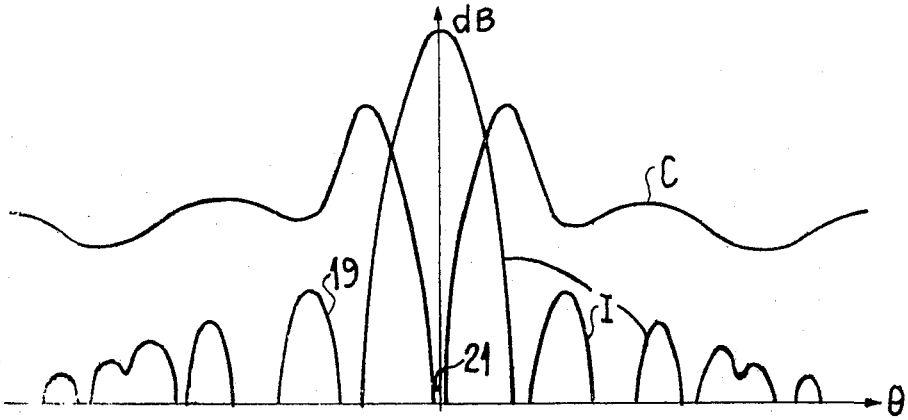
FIG. 4 shows the radiation pattern of the interrogation/response channel of the radar overlain by the radiation pattern of the control channel.

FIG. 4 shows the directional pattern I of the interrogation/response channel overlain by a pattern C of the control channel of the differential type. The centerline of a gap 21 in the differential pattern C is the same as that of the major lobe 18 of the sum pattern I. The lateral lobes 19 of the radiation pattern I are submerged in the radiation pattern of the control channel C.

What is claimed is:

1. A bifunctional antenna for a primary/secondary radar system, comprising:

a reflector with a body of dielectric material having a concave front surface adapted to be illuminated by a primary source of outgoing radiation for detecting a remote target;

a row of secondary radiation transceivers disposed along a generatrix of said front surface intersecting a boresight axis, said transceivers being formed by slots in said front surface backed by cavities having walls integral with said body, said cavities being provided with excitation means; and feed means connected to said excitation means for energizing said transceivers from a secondary source in a directive sum pattern to emit interrogation signals and superimposing upon said sum pattern a differential control pattern blanking minor lobes of said sum pattern.

2. An antenna as defined in claim 1 wherein said feed means includes phase-shifting means for energizing two groups of said transceivers, symmetrically disposed about said boresight axis, in mutual phase opposition to generate said control pattern.

3. An antenna as defined in claim 2 wherein said feed means further includes a power divider linked by coaxial connections to said transceivers.

4. An antenna as defined in claim 1, 2 or 3 wherein said transceivers are energizable by said feed means with staggered amplitudes conforming to a Gaussian distribution during transmission of said interrogation signals.

5. An antenna as defined in claim 1, 2 or 3 wherein said body is covered at said front surface with two sets of orthogonally intersecting insulated metal wires, the walls of said cavities being covered by extensions of said intersecting wires.

6. An antenna as defined in claim 1 wherein said cavities are filled with said dielectric material.

7. An antenna as defined in claim 5 wherein said primary source has a plane of polarization parallel to one of said sets of wires, some of the wires of said one of said sets extending across said slots, said excitation means having a direction of polarization perpendicular to said plane.

8. An antenna as defined in claim 7 wherein the wires of said one of said sets are parallel to said generatrix.

9. An antenna as defined in claim 8 wherein said generatrix lies in a horizontal midplane of said reflector.

10. An antenna as defined in claim 1 wherein said reflector is provided with a cap of dielectric material complementing said body to a closed shell and having a convex rear surface, at least some of said cavities being substantially symmetrically duplicated by supplemental cavities in said shell terminating at rearwardly facing slots in said convex surface and containing excitation means connected to said feed means.

11. A bifunctional antenna for a primary/secondary radar system, comprising:

a reflector with a concave front surface adapted to be illuminated by a primary source of outgoing radiation for detecting a remote target, said front surface having a row of slots disposed along a generatrix thereof, said reflector having a body of dielectric material forming respective cavities behind said slots;

excitation means in said cavities energizable from a secondary source to emit a directive interrogation pattern of radiation with a polarization direction perpendicular to a plane of polarization of said primary source; and two sets of orthogonally intersecting insulated metal wires extending over said front surface and along the walls of said cavities, the wires of one of said sets being parallel to said plane to polarization direction, some of the wires of said one of said sets extending across said slots.

12. An antenna as defined in claim 11 wherein the wires of said one of said sets are horizontal, said generatrix lying in a horizontal midplane of said reflector.

13. An antenna as defined in claim 11 wherein said cavities are filled with said dielectric material.

14. An antenna as defined in claim 11, 12, or 13 wherein said dielectric material is a glass mat impregnated with epoxy resin.

15. An antenna as defined in claim 11, 12, or 13 wherein said wires are incorporated in a glass-fiber fabric.

16. An antenna as defined in claim 11, 12, or 13 wherein said reflector is provided with a cap of said dielectric material complementing said body to a closed shell and having a convex rear surface, at least some of said cavities being substantially symmetrically duplicated by supplemental cavities in said shell terminating at rearwardly facing slots in said convex surface and containing excitation means connected to said secondary source.

* * * * *